US005269328A

United States Patent [19]

Gasparics

[11] Patent Number: 5,269,328

[45] Date of Patent: Dec. 14, 1993

[54] SAFETY CIGARETTE HOLDER

[75] Inventor: Istvan Gasparics, Vancouver, Canada

[73] Assignee: Super Gadget Ashtray Ltd., Vancouver, Canada

[21] Appl. No.: 868,417

[22] Filed: Apr. 15, 1992

[51] Int. Cl.[5] ..... A24F 19/14

[52] U.S. Cl. ..... 131/240.1; 131/241; 131/235.1; 131/257; 211/70.3

[58] Field of Search ..... 131/235.1, 231, 240.1, 131/241, 260, 235.1, 256, 257, 237; 248/110, 113, 316.2, 316.3; 211/60.1, 69.1, 69.8, 70.3

[56] References Cited

U.S. PATENT DOCUMENTS 1,894,128 1/1933 Schult .
1,965,973 7/1934 Brown ..... 248/316.3
2,099,125 11/1937 Langslow .
2,370,876 3/1945 Richardson ..... 248/316.3
2,448,105 8/1948 Lynch .
2,498,330 2/1950 Block .
2,800,909 7/1957 Schlatterer .
3,841,339 10/1974 Fox et al. ..... 131/235.1
4,617,944 10/1986 Gasparics ..... 131/235.1

*Primary Examiner*—V. Millin
*Assistant Examiner*—William M. Pierce
*Attorney, Agent, or Firm*—Barrigar and Oyen

[57] ABSTRACT

A cigarette holder for use on an ashtray is provided. Opposed cylinders rotate and move freely within opposite compartments to grip the cigarette, but are constrained to extend from opposite open ends of such compartments a distance which leaves a minimum separation between the cylinders which is less than the diameter of a cigarette.

18 Claims, 4 Drawing Sheets

SAFETY CIGARETTE HOLDER

FIELD OF THE INVENTION

The invention relates to cigarette holders for use on ashtrays.

BACKGROUND OF THE INVENTION

A common cause of residential fires is a lit cigarette falling from an ashtray and igniting furniture or draperies. A typical ashtray has a notch or groove in the outer circumference thereof on which the lit cigarette is balanced, with the lit end overhanging the central area of the ashtray, when not held by the smoker. Often the smoker falls asleep, and as the lit end of the cigarette burns down, the cigarette becomes unbalanced and falls out of the ashtray, potentially causing a fire.

The present inventor has invented a safety cigarette holder to avoid this problem, disclosed in U.S. Pat. No. 4,617,944 issued Oct. 21, 1986. In that device, two cylindrical metal rings are resiliently mounted on elastomeric pieces which are in turn supported on the ashtray by a supporting frame. The two rings are spaced apart less than the diameter of a cigarette so that when a cigarette is pressed between the two rings it displaces the rings and passes below the centre of the two rings, which then bear down on the cigarette to retain it in place. Thus the cigarette may burn down until it comes into contact with the metal rings while still being held in place by the rings.

A problem with the inventor's previous cigarette holder design is that it is expensive and difficult to mass-produce. The present invention provides a structure for achieving the same benefits as the inventor's previous safety cigarette holder which is simpler and less expensive to mass produce.

SUMMARY OF THE INVENTION

The present invention provides an apparatus for holding a cigarette on an ashtray, comprising a housing forming two spaced, opposed compartments, open at the adjacent opposing ends thereof; a movable non-flammable cigarette-contacting element provided in each compartment and partially extending from the open end thereof; and spring means mounted within each compartment to bias the cigarette-contacting element towards the open end of each said compartment; wherein said housing is adapted to limit the movement of the cigarette-contacting elements out of the compartments, whereby the separation of said cigarette-contacting elements when in their position of maximum extension from the compartments is less than the diameter of a standard cigarette. Preferably the cigarette-contacting elements are cylinders or spheres which rotate freely within said compartments, and have a diameter greater than that of a standard cigarette.

BRIEF DESCRIPTION OF THE DRAWINGS

In drawings which illustrate a preferred embodiment of the invention.

DETAILED DESCRIPTION OF THE PREFERRED EMBODIMENT

Figure 1:
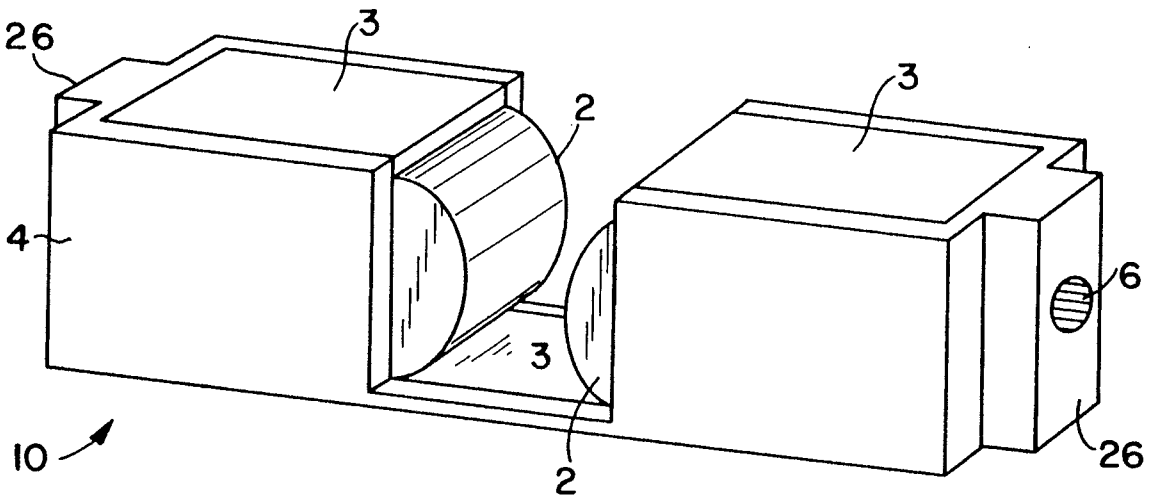
FIG. 1 is an isometric view of the cigarette holder of the invention.
Figure 2:
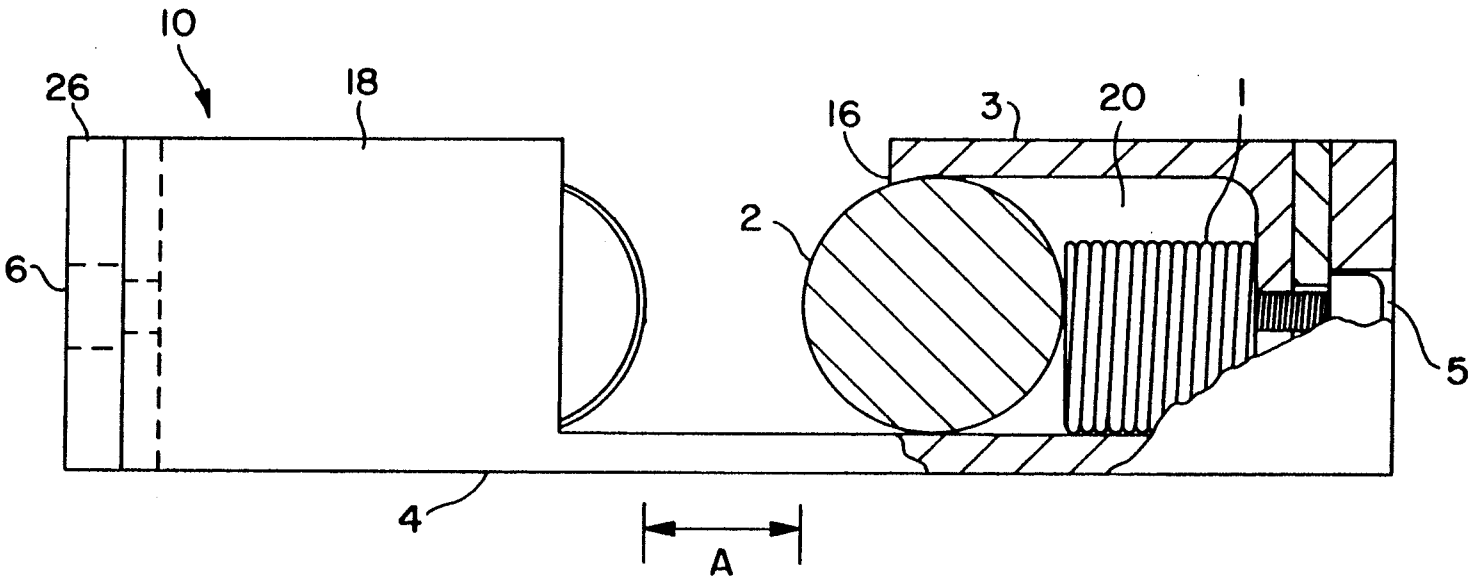
FIG. 2 is an elevational view, partially cut away, of the cigarette holder of the invention.
Figure 3:
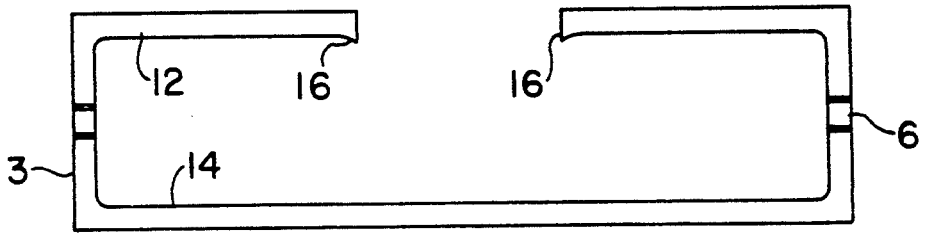
FIG. 3 is a side elevation view of the inner case of the invention.
Figure 4:
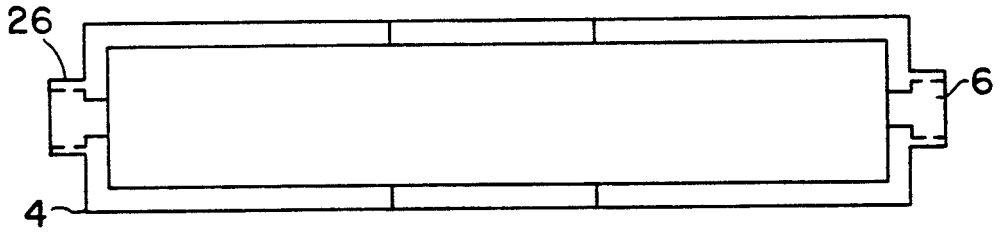
FIG. 4 is a top view of the outer case of the invention.

With reference to FIGS. 1 through 4, a cigarette holder 10 comprises an outer case 4, inner case 3, two springs 1 and two hollow cylinders 2 which rotate and move freely within inner case 3. A screw 5 secures the inner case to the outer case through hole 6. Cylinders 2 are formed of a non-flammable material such as zinc, copper, aluminum or a non-flammable thermoplastic. The inner and outer casing is preferably a stainless steel but could also be a moulded plastic. Spring 2 is typically a phosphor bronze material whose deflection is selected according to the criteria described below. A suitable size has been found to be a length of 0.575 inches, wire diameter of 0.02 inches, outside diameter of 0.32 inches with 18 turns and open ends. The inner case 3 nests within outer case 4, which is open at the top and bottom.

Cylinder 2 has a diameter of 0.45 inches and a width of 0.375 inches, with slightly chamfered edges. This permits it to roll freely between the walls of the outer case, the width of whose inner trough is about 0.384 inches, and between the upper and lower walls 12, 14 of inner case 3 which are about 0.458 inches apart. However the lower surface of upper wall 12 has a downwardly extending lip 16 which is spaced a distance from lower wall 14 which is less than the diameter of cylinder 2, thus forming two compartments 18, 20 from which the two cylinders cannot escape. Springs 1 are placed within compartments 18, 20 between end walls 22 of inner case 3 and cylinders 2 to cause the cylinders to bear outwardly against lips 16.

The dimensions of the cylinders and casing are chosen so that the space A between the two cylinders 2 is slightly less than the diameter of a cigarette, which in turn is less than the diameter of cylinders 2. In this way, when a cigarette is inserted between cylinders 2, the cylinders will be pressed apart, and will return slightly after the mid-point of the cigarette passes below the midpoint of the cylinders, causing downward pressure to be placed on the cigarette by the cylinders. When the burning end of the cigarette comes into contact with cylinders 2 it will be extinguished.

The cigarette holder unit 10 is manufactured by compressing the spring and sliding both springs and cylinders into place within the inner casing 3, sliding the inner casing into place in the outer casing and securing the inner and outer case by screws 5 through threaded holes 6.

Figure 5:
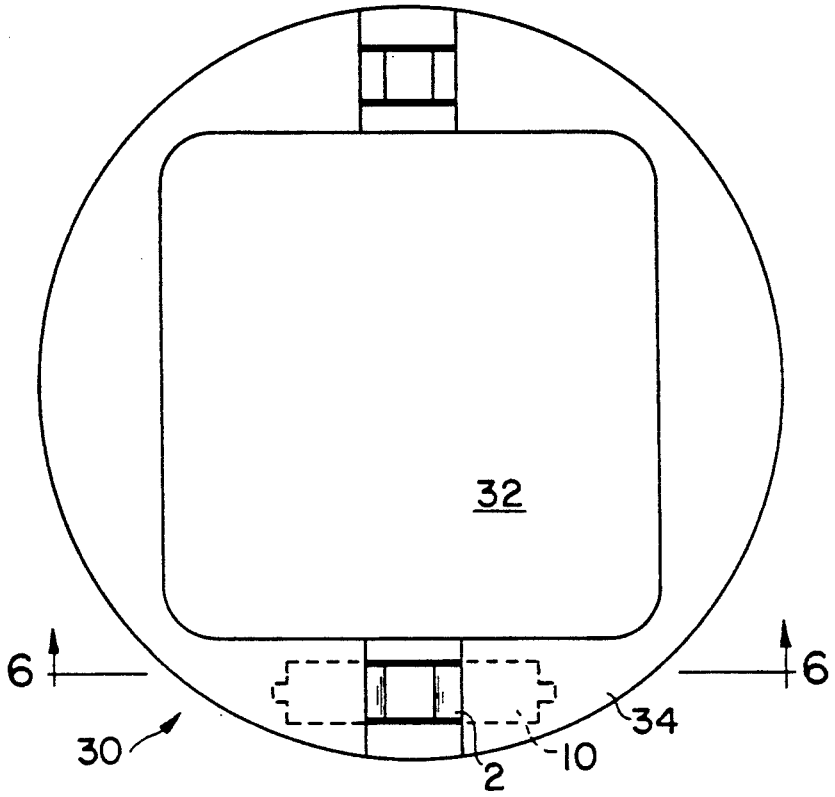
FIG. 5 is a top view of an ashtray provided with two cigarette holders according to the invention.

The assembled cigarette holder unit can be readily incorporated into an ashtray 30 as shown in FIG. 5 by providing a slot in the appropriate location into which unit 10 can fit, with grooves provided into which tongues 26 may fit. The unit will be so positioned on the raised portion 34 of the ashtray that when the unlit end of the cigarette is inserted between cylinders 2, the lit end will extend over the ash-receiving area 32 of the ashtray. For example, car ashtrays could be designed to have units 10 inserted into slots in the ashtray structures and secured after assembly of the automobile.

Figure 6:
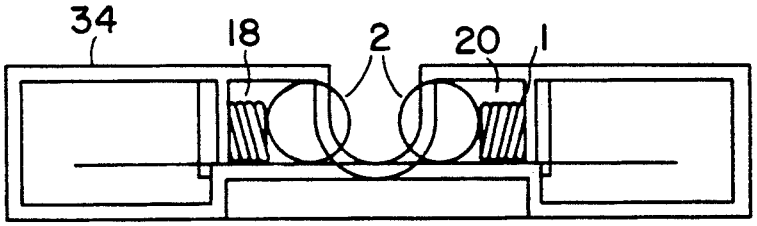
FIG. 6 is a cross-sectional view taken along lines 6—6 of FIG. 5.

It will also be apparent that compartments 18, 20, as shown in FIGS. 5 and 6, can be formed within the body of the ashtray itself, rather than forming a separate independent unit 10. The body of ashtray 30 would be moulded in two or more parts to permit the cylinders and springs to be inserted prior to assembly, with lips such as lips 16 being provided to limit the movement of the cylinders when the ashtray parts are assembled.

While the preferred embodiment has been shown using free-rolling cylinders, other shapes are also useful, such as spheres, which would also be free rolling and acted upon by spring 1.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. Apparatus for holding a cigarette on an ashtray, comprising:

a) a housing having first and second spaced, opposed compartments, each said compartment having an open end, said open end of said first compartment facing the open end of said second compartment;

b) two movable non-flammable cigarette-contacting elements, one of said cigarette-contacting elements movable in each said compartment to partially extend from the open end of the compartment in which said cigarette-contacting element is movable; and c) spring means to bias each said cigarette-contacting element towards the open end of each said compartment;

wherein each said cigarette-contacting element is adapted to move within its respective compartment between a retracted position and a position of maximum extension wherein a portion of said cigarette-contacting element extends from the open end of said compartment, whereby the separation of said cigarette-contacting elements when each is in its said position of maximum extension from said compartments is less than the diameter of said cigarette.

2. The apparatus of claim 1 wherein said cigarette-contacting elements are cylindrical.

3. The apparatus of claim 2 wherein the diameter of said cylindrical elements is greater than the diameter of said cigarette.

4. The apparatus of claim 2 wherein said cylindrical cigarette-contacting elements each have a central axis which is aligned perpendicular to the direction of movement of said cigarette-contacting elements and whereby said cigarette-contacting elements are able to roll in said compartments about said axis.

5. The apparatus of claim 1 wherein said open ends are rectangular and said housing is provided with a lip extending partially across each said open end along one edge of said open end.

6. The apparatus of claim 1 wherein said housing further comprises a cigarette-supporting surface extending between said open ends of said compartments, wherein each of said cigarette-contacting elements has an exterior surface such that when said cigarette-contacting element is in its position of maximum extension from said compartment, said cigarette-contacting element has a point of maximum distance from said compartment on said exterior surface of said cigarette-contacting element and the height of said point of maximum distance of said cigarette-contacting elements above said cigarette-supporting surface is greater than the radius of said cigarette.

7. The apparatus of claim 6 wherein said exterior surface of said cigarette-contacting element is curved in the vicinity of said point of maximum extension from said compartment.

8. The apparatus of claim 1 wherein said housing further comprises a cigarette-supporting surface extending between said open ends of said compartments, wherein each of said cigarette-contacting elements has an exterior surface such that when said cigarette-contacting element is in its position of maximum extension from said compartment, said cigarette-contacting element has a region of maximum distance from said compartment on said exterior surface of said cigarette-contacting element and the height of said region of maximum distance of said cigarette-contacting elements above said cigarette-supporting surface is greater than the radius of said cigarette.

9. The apparatus of claim 8 wherein said exterior surface of said cigarette-contacting element is curved in the vicinity of said region of maximum extension from said compartment.

10. An ashtray comprising means for holding a cigarette on said ashtray, said cigarette-holding means comprising:

a) a housing having first and second spaced, opposed compartments, each said compartment having an open end, said open end of said first compartment facing the open end of said second compartment;

b) a movable non-flammable cigarette-contacting element provided in each said compartment and partially extending from the open end of said compartment; and c) spring means to bias each said cigarette-contacting element towards the open end of each said compartment;

wherein each said cigarette-contacting element is adapted to move within its respective compartment between a retracted position and a position of maximum extension wherein a portion of said cigarette-contacting element extends from the open end of said compartment, whereby the separation of said cigarette-contacting elements when each is in its said position of maximum extension from said compartments is less than the diameter of said cigarette.

11. The apparatus of claim 10 wherein said cigarette-contacting elements are cylindrical.

12. The apparatus of claim 11 wherein the diameter of said cylindrical elements is greater than the diameter of said cigarette.

13. The apparatus of claim 11 wherein said cylindrical cigarette-contacting elements each have a central axis which is aligned perpendicular to the direction of movement of said cigarette-contacting elements and whereby said cigarette-contacting elements are able to roll in said compartments about said axis.

14. The apparatus of claim 10 wherein said open ends are rectangular and said housing is provided with a lip extending partially across each said open end along one edge of said open end.

15. The apparatus of claim 10 wherein said housing further comprises a cigarette-supporting surface extending between said open ends of said compartments, wherein each of said cigarette-contacting elements has an exterior surface such that when said cigarette-contacting element is in its position of maximum extension from said compartment, said cigarette-contacting element has a point of maximum distance from said compartment on said exterior surface of said cigarette-contacting element and the height of said point of maximum distance of said cigarette-contacting elements above said cigarette-supporting surface is greater than the radius of said cigarette.

16. The apparatus of claim 10 wherein said housing further comprises a cigarette-supporting surface extending between said open ends of said compartments, wherein each of said cigarette-contacting elements has an exterior surface such that when said cigarette-contacting element is in its position of maximum extension from said compartment, said cigarette-contacting element has a region of maximum distance from said compartment on said exterior surface of said cigarette-contacting element and the height of said region of maximum distance of said cigarette-contacting elements above said cigarette-supporting surface is greater than the radius of said cigarette.

17. The apparatus of claim 16 wherein said exterior surface of said cigarette-contacting element is curved in the vicinity of said region of maximum extension from said compartment.

18. The apparatus of claim 15 wherein said exterior surface of said cigarette-contacting element is curved in the vicinity of said point of maximum extension from said compartment.

* * * * *